US005960733A

United States Patent [19]

Thon

[11] Patent Number: 5,960,733

[45] Date of Patent: Oct. 5, 1999

[54] APPARATUS FOR RELEASABLY CONNECTING CONSTRUCTION COMPONENTS

[76] Inventor: Ralph C. Thon, 118 Skylark, Bridge City, Tex. 77611

[21] Appl. No.: 08/937,974

[22] Filed: Sep. 26, 1997

Related U.S. Application Data

[60] Provisional application No. 60/025,307, Sep. 24, 1996.

[51] Int. Cl.[6] ..... B63B 35/44

[52] U.S. Cl. ..... 114/266; 114/249; 403/31

[58] Field of Search ..... 114/266, 267, 114/249; 403/31

[56] References Cited

U.S. PATENT DOCUMENTS 3,799,101 3/1974 Finefrock ..... 114/249

4,811,681 3/1989 Robishaw et al. ..... 114/267

*Primary Examiner*—Jesus D. Sotelo

*Attorney, Agent, or Firm*—Ronald B. Sefrna

[57] ABSTRACT

Apparatus for releasably connecting floating barge sections or other construction components includes a fluid actuated cylinder and piston assembly disposed in an open-ended sleeve in a first component with the piston connected to the construction component and the cylinder movable between a retracted position within the sleeve and an extended position such that a portion of the cylinder extends into and is releasably locked in place within a socket in a second construction component.

13 Claims, 3 Drawing Sheets

APPARATUS FOR RELEASABLY CONNECTING CONSTRUCTION COMPONENTS

RELATED APPLICATION DATA

This application is a continuation in part of U.S. patent application Ser. No. 60/025,307, filed Sep. 24, 1996, titled "Apparatus For Releasably Connecting Construction Components".

FIELD OF THE INVENTION

The present invention generally relates to apparatus for forming connections between construction components, and in its preferred embodiments more specifically relates to apparatus for releasably connecting barges, floats, pontoons, and similar floating components.

BACKGROUND OF THE INVENTION

Systems for connecting barge sections and other floating components are known in the prior art material to this general field. Many prior art systems provide a plurality of male members, or pins, along one side of a barge section, with the pins extending outwardly from the side of the barge, and a plurality of female members, or sockets, along the opposite side of the barge section. The pins and sockets are disposed so that the pins of one barge section will align with and be received in the sockets of another barge section when the two barge sections are brought into appropriate side by side alignment. In the typical prior art systems, a locking mechanism is used to engage the pins in the sockets and prevent their removal from the socket while the locking mechanism is in place. The locking mechanism is typically associated with the sockets and is activated from the upper surface of the barge section. In order to securely connect the two barge sections and prevent hinging motion from occurring between the two, the pins and the matching sockets are typically provided in at least two vertically separated rows. It is also known to position pins and sockets in vertically aligned pairs, and to adapt the locking mechanism so that a single mechanism will engage both upper and lower pins in aligned sockets, in order to facilitate connection and disconnection between the floating barge sections. It is desirable that the locking mechanism be retained in the barge section rather than removable in use, to prevent misplacement or loss of locking mechanism components.

In most connection systems the pins are fixed in place and permanently connected to the side of the barge section. The fixed pin design does provide for secure attachment, but there is a significant disadvantage in the permanent extension of the pins from the side of the barge section. Extension of the pins from the side of a free barge section creates a hazard, and the fixed pins can be more difficult to align and mate with sockets during the connection operation. Fixed pins can also create difficulties during disconnection of barge sections.

In an effort to address the disadvantages associated with fixed pins, in at least one prior art design the pins are retractable to a recessed position, where they may be locked in place. Each pin moves longitudinally in a sleeve, and is biased toward its extended position by a spring disposed behind the pin in the sleeve. The pins are locked in the recessed position by a releasable locking mechanism, so that they may be released during alignment and connection of two barge sections. When the pins are released the associated springs push them forward so that each pin can extend into a matching socket, where they may be locked in place by a second locking mechanism. This design, which is exemplified by U.S. Pat. No. 4,610,215 to Robishaw, does eliminate the disadvantage of permanently fixed pins as a hazard or impediment to barge section movement, but has its own set of drawbacks and disadvantages.

With the described retractable pin design, an operator has no positive means to control the extension of the pin, other than releasing the locking mechanism holding pins in the retracted position. If a pin should jam or the spring fail to fully extend the pin for any reason, the design does not provide or allow a means of adjusting the position of the pin or varying the extension force. Therefore, any improper extension cannot be corrected.

Another disadvantage of the prior art retractable pin system design is that it provides no means of retracting a pin other than directly forcing the pin back in the sleeve against the spring tension. In practice, retraction requires hammering or pushing each pin into its retracted position until it can be engaged by the locking mechanism to hold it in the retracted orientation. As a result, pins cannot be retracted unless the barge section bearing the pins is fully disconnected and moved away from adjacent barge section or sections. In some situations this limitation is a significant disadvantage and can be the source of difficulty and work delay.

Still further, the described prior art retractable pin system does not provide any means for adjusting the pin position. Barges and other similar construction components typically are used for extended periods of time, and it is not unusual for barge sections to sustain some degree of damage and physical distortion during their useful lifetimes. It is highly desirable for the connection apparatus to be adjustable to accommodate distortions in otherwise useable barge sections and allow them to be closely connected in the required manner. In addition, the connection apparatus components themselves are subject to wear over a period of time, but the prior art connection systems provide no means of compensating for wear, other than replacing otherwise serviceable components.

SUMMARY OF THE INVENTION

The present invention provides an improved apparatus and an improved method of releasably connecting components such as barge sections, floats, pontoons, and the like. The apparatus is particular useful for connecting components that are floating on a body of water, where access to the components and locking locations is limited, and where the components are likely to be in motion relative to each other.

The present invention retains the best and most effective features of prior art designs while addressing and overcoming the significant disadvantages and drawbacks associated with those prior art designs. The present invention provides a connection apparatus with an extendable and retractable male member formed, in the preferred embodiment, by a fluid actuated double acting cylinder so that the cylinder becomes an integral part of the connection between two barge sections, floats, or other construction components. The cylinder is provided with fluid lines and connections for remote actuation, allowing it to be extended and retracted without the need for direct worker contact with or manipulation of the cylinder. The cylinder is also longitudinally adjustable, so that its position may be adjusted relative to the barge section to which it is mounted and thus may be adjusted relative to the socket of the barge to which it is to form a connection.

The structure and features of the apparatus of the invention will be described in detail with reference to the accompanying drawing figures.

DESCRIPTION OF THE PREFERRED EMBODIMENT

Figure 1:
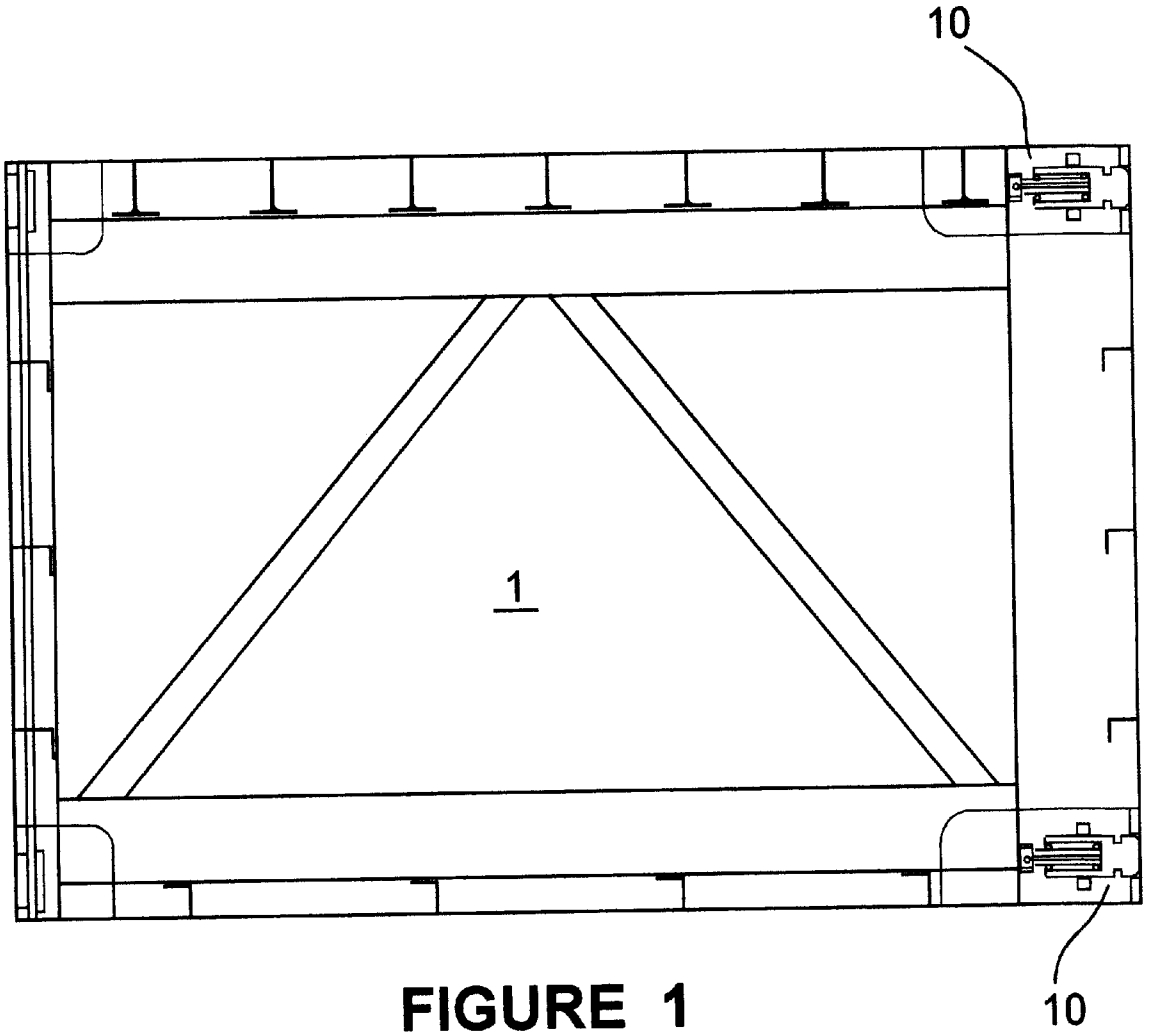
FIG. 1 is a transverse sectional view of typical barge components showing the apparatus of the invention.
Figure 2:
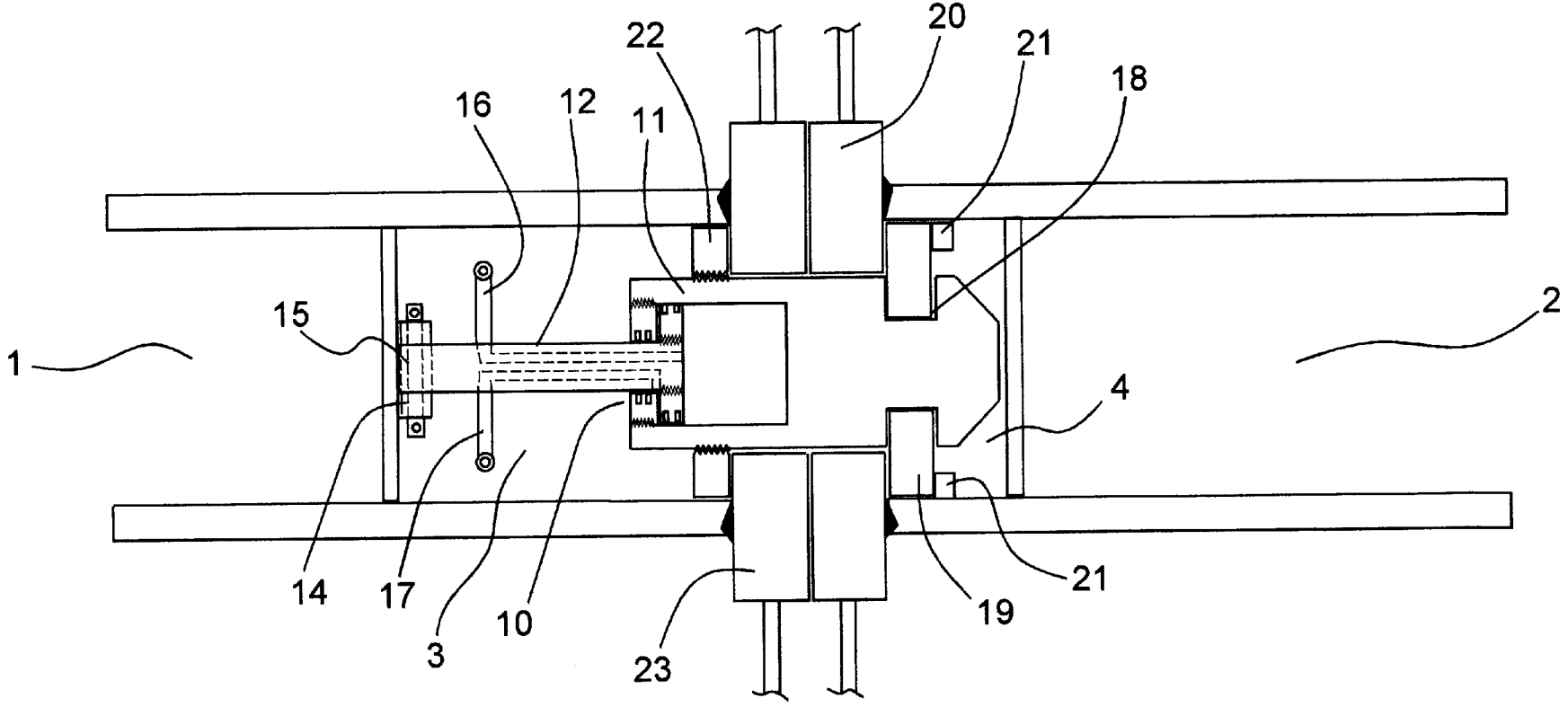
FIG. 2 is a sectioned top plan view of the apparatus of the invention in extended, locked orientation.
Figure 3:
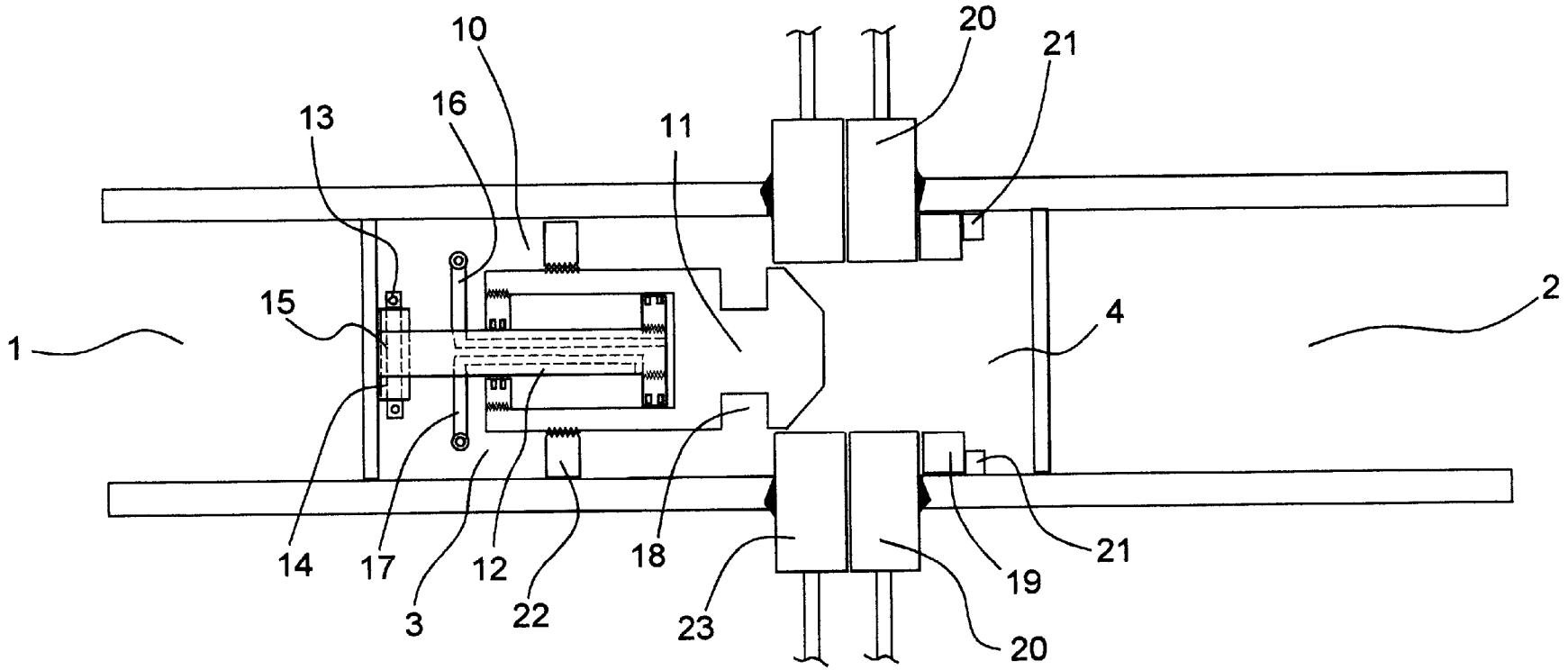
FIG. 3 is a sectioned top plan view of the apparatus of the invention in retracted, unlocked orientation.

Referring now to the drawing figures, FIG. 1 illustrates a typical barge section in a top plan view, and shows a typical position for the cylinder assembly of the invention, generally designated by reference numeral 10. The cylinder assembly is shown in greater detail in its extended position in FIG. 2, and in its retracted position in FIG. 3. FIGS. 2 and 3 provide cross-sectional views for clarity.

The cylinder assembly includes a main cylinder body 11, which moves relative to a fixed piston 12. The piston is connected to the barge section, preferably in conjunction with a truss to provide appropriate strength and rigidity. In FIGS. 2 and 3, two barge sections, 1 and 2, are shown in aligned relationship, with the cylinder 11 mounted in sleeve 3 of barge section 1 and aligned with a socket 4 in barge section 2, such that cylinder 11 is free to move longitudinally within the sleeve. In the preferred embodiment the free end of piston 12 is pivotally connected to barge section 1 by a pivot pin 13 removably extending through mounting bracket 14 and through a mounting aperture 15 in the free end of piston 12. Two fluid lines are provided in association with the cylinder and piston; fluid line 16 for extension of the cylinder and fluid line 17 for retraction of the cylinder. When pressurized fluid is introduced to line 16 the cylinder is forced outwardly in sleeve 3 relative to fixed piston 12 and extends to be received in the mating socket 4. Conversely, when pressurized fluid is introduced to line 17 the cylinder is forced inwardly and is withdrawn from the socket. Although not preferred, in an alternative embodiment the apparatus of the invention could be provided with cylinder 11 connected to barge section 1 such that piston 12 is caused to move in sleeve 3 upon introduction of pressurized fluid.

Figure 4:
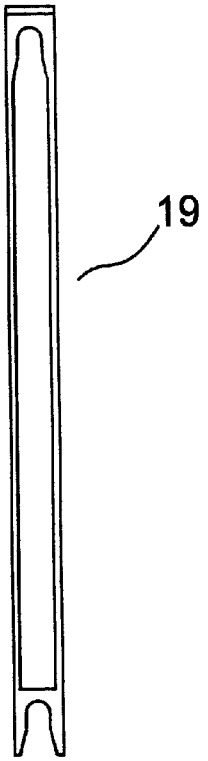
FIG. 4 is an elevation view of a locking bar component of the apparatus of the invention.

The outer end of cylinder 11 is provided with a locking groove 18 to receive a locking bar 19. Locking bar 19 is shown in FIG. 4. In the preferred embodiment shown, locking bar 19 is designed to simultaneously lock two cylinders disposed in vertically aligned relationship. However, locking bar 19 may be readily adapted to lock a single cylinder, or to accommodate more than two vertically aligned cylinders. The locking bar is associated with socket 4 in barge section 2, and slides between guides 20 and 21 to allow vertical movement of the locking bar while maintaining it in position for engagement with locking groove 18 when cylinder 11 is extended into socket 4. Locking bar 19 is adapted so that it is frictionally restrained from movement due to the action of gravity and will stay in either locked or unlocked position until positively moved from one position to the other. Restraint of the locking bar prevents it from falling to the normal locked position before cylinder 11 is fully extended into the mating socket. The locking bar may be restrained by any convenient conventional means.

Cylinder 11 is guided in its longitudinal movement by guide nut 22, which is adjustably threaded onto the outer surface of the cylinder. In the preferred embodiment guide nut 22 is a square nut with a threaded central aperture. The guide nut slides within sleeve 3, which in the preferred embodiment is a portion of a truss component of the barge section and is square in cross-sectional configuration to match the configuration of sleeve 3. Guide nut 22 abuts stop 23 to terminate further extension of the cylinder. Guide nut 22 is longitudinally adjustable along cylinder 11 and may be positioned to control the distance of extension of the cylinder, allowing a degree of control not previously possible.

When cylinder 11 is extended into socket 4 and locking bar 19 is positioned in locking groove 18, guide nut 22 is disposed fly against stop 23, and cylinder 11 is rigidly retained and supported in its extended position. The rigid retention of cylinder 11 between the locking bar and guide nut assures that the connection between the two barge sections or other construction components is rigid and secure, and eliminates the need for a second locking bar associated with barge section 1 or other component to restrain movement of the cylinder. The rigid retention of cylinder 11 also eliminates transfer of stresses imposed upon the cylinder to piston 12, to the seals between cylinder 11 and piston 12, and to the connection between piston 12 and barge section 1. Isolation of the activation means from the substantial stresses that may be transferred between barge sections significantly reduces maintenance requirements and allows the use of lighter, and correspondingly less expensive, components than would otherwise be possible.

The cylinder of the connection apparatus of the invention can be extended and retracted at will with great force, and with variable force, driven by a pressurized fluid. The use of a gas, such as carbon dioxide or air is preferred for the activation fluid, although liquid could be used. The use of a liquid for the activation fluid would require the use of more complex pumping apparatus, and many liquid hydraulic fluids are potential pollutants to the environment. Activation gas can be stored in an easily moved storage container that can be readily moved and placed where needed to extend or retract the cylinder of the connection apparatus. Through the use of a regulator, gas pressure can be controlled to provide variable activation force to the cylinder. Activation of the cylinder is performed by simply applying a conventional hose fitting to a connection similar to the valve stem of an automobile tire and supplying gas to the cylinder.

It will be understood that the cylinder of the connection apparatus of the invention can be retracted without physical separation of the barge sections or other construction components, and thus provides a significant improvement and advantage over the prior art connection apparatus. The connection apparatus of the invention is simple and inexpensive to construct and install, and can be readily removed for repair, adjustment, or replacement.

The foregoing description of the apparatus of the invention is illustrative and not for purposes of limitation. The apparatus of the invention is susceptible to various modifications and alternative embodiments within the scope of the invention as claimed.

I claim:

1. Apparatus for releasably connecting first and second construction components, each having a mating face, comprising an sleeve having an open first end and a second end formed in said first construction component with said open first end of said sleeve aligned with said mating face thereof;

a socket having an open first end and a second end formed in said second construction component with said open first end of said socket aligned with said mating face thereof;

a fluid actuated cylinder and piston assembly including a cylinder body with first and second ends and a piston with first and second ends, said cylinder disposed in telescoping relation with said piston with said first end of said piston extending into the interior of said cylinder and said second end of said piston extending outwardly from said second end of said cylinder, said cylinder and piston assembly disposed in said sleeve with said second end of said piston connected to said first construction component at said second end of said sleeve and with said cylinder longitudinally movable in said sleeve between a retracted position with said cylinder fully within said sleeve and an extended position with said first end of said cylinder extending outwardly from said sleeve beyond said mating face of said first construction component, such that said first end of said cylinder is received in said socket with said mating face of said first construction component against said mating face of said second construction component, with said sleeve aligned with said socket, and with said cylinder in said extended position; and locking means to releasably retain said first end of said cylinder in said socket.

2. The apparatus of claim 1, further comprising activation means for actuating movement of said cylinder between said retracted position and said extended position.

3. The apparatus of claim 2, wherein said activation means comprises a first fluid line for conveying pressurized fluid to the interior of said cylinder so as to induce movement of said cylinder to said extended position from said retracted position, and a second fluid line for conveying pressurized fluid to the interior of said cylinder so as to induce movement of said cylinder to said retracted position from said extended position.

4. The apparatus of claim 1, wherein said locking means comprises a locking groove formed in said cylinder near said first end thereof, and a locking bar movably disposed in said socket to releasably engage said locking groove with said first end of said cylinder disposed in said socket.

5. The apparatus of claim 1, further comprising guide means for guiding movement of said cylinder in said sleeve.

6. The apparatus of claim 5, wherein said cylinder includes threads formed on the outer surface thereof, and wherein said guide means comprises a nut with a threaded central aperture, said nut threaded onto said cylinder.

7. The apparatus of claim 6, wherein the position of said nut on said cylinder between said first and second ends thereof is adjustable.

8. The apparatus of claim 7, wherein said nut and said sleeve are of the same cross-sectional configuration, and wherein said nut is dimensioned to be received in said sleeve in closely fitted sliding relationship thereto.

9. The apparatus of claim 8, wherein said nut and said sleeve are non-circular in cross-sectional configuration.

10. The apparatus of claim 8, further including a stop means interconnected to said sleeve at said open end thereof to engage said nut and arrest extension of said first end of said cylinder from said sleeve.

11. The apparatus of claim 1, wherein said second end of said piston is pivotally connected to said first construction component.

12. The apparatus of claim 1, wherein said cylinder and piston assembly is pneumatically actuated.

13. The apparatus of claim 1, wherein said cylinder and piston assembly is hydraulically actuated.

* * * * *